US012447374B2

(12) United States Patent
Wallander

(10) Patent No.: US 12,447,374 B2
(45) Date of Patent: Oct. 21, 2025

(54) RETRACTION DEVICE

(71) Applicant: William Wallander, Dallas, TX (US)

(72) Inventor: William Wallander, Dallas, TX (US)

(73) Assignee: Nuvalux LLC, Dallas, TX (US)

( * ) Notice: Subject to any disclaimer, the term of this patent is extended or adjusted under 35 U.S.C. 154(b) by 191 days.

(21) Appl. No.: 17/988,926

(22) Filed: Nov. 17, 2022

(65) Prior Publication Data

US 2024/0165452 A1 May 23, 2024

(51) Int. Cl.

| | |
|---|---|
| ***A63B 21/00*** | (2006.01) |
| ***A63B 21/16*** | (2006.01) |
| ***A63B 24/00*** | (2006.01) |

(52) U.S. Cl.

CPC ..... *A63B 21/153* (2013.01); *A63B 21/00061* (2013.01); *A63B 21/16* (2013.01); *A63B 24/0062* (2013.01); *A63B 2220/833* (2013.01); *A63B 2225/15* (2013.01); *A63B 2225/50* (2013.01)

(58) Field of Classification Search

CPC ..... A63B 21/15; A63B 21/151; A63B 21/152; A63B 21/153; A63B 21/154; A63B 21/155; A63B 21/156; A63B 21/157; A63B 21/16; A63B 21/22; A63B 21/4001; A63B 21/4009; A63B 21/4025

See application file for complete search history.

(56) References Cited

U.S. PATENT DOCUMENTS

| | | | | |
|---|---|---|---|---|
| 5,733,231 | A * | 3/1998 | Corn | A63B 21/153 482/127 |
| 6,149,559 | A * | 11/2000 | Mackey | A63B 21/16 482/904 |
| 7,632,221 | B1 * | 12/2009 | Kolander | A63B 23/03525 482/102 |
| 10,376,732 | B2 * | 8/2019 | Garsdean | A63B 23/03525 |
| 10,814,172 | B1 * | 10/2020 | Ilfrey | A63B 23/035 |
| 11,161,012 | B1 * | 11/2021 | Hendricks | A63B 21/0724 |
| 11,389,699 | B2 * | 7/2022 | Mallard | H04W 4/38 |
| 11,779,796 | B2 * | 10/2023 | Larson | A63B 21/4043 482/139 |
| 11,833,382 | B2 * | 12/2023 | Kelly | A63B 21/0442 |
| 11,896,875 | B1 * | 2/2024 | Hendricks | A63B 21/0058 |
| 12,023,541 | B2 * | 7/2024 | Simenthi | A63B 21/4043 |
| 2002/0025891 | A1 * | 2/2002 | Colosky, Jr. | A63B 23/00 482/127 |
| 2007/0155587 | A1 * | 7/2007 | Huang | A63B 23/12 482/148 |

(Continued)

FOREIGN PATENT DOCUMENTS

| | | |
|---|---|---|
| CN | 216755290 U | 6/2022 |

OTHER PUBLICATIONS

Korean Patent Office, International Search Report issued in PCT/US2023/0189731, Aug. 21, 2023, 5 pages.

(Continued)

*Primary Examiner* — Zachary T Moore

(74) *Attorney, Agent, or Firm* — Barnes & Thornburg LLP; Jerry C. Harris, Jr.

(57) ABSTRACT

A retraction apparatus includes a housing and a retractable cable extending from the housing. An attachment mechanism is configured to couple to a free end of the retractable cable. A tensioning mechanism is configured to restrict movement of the retractable cable.

24 Claims, 10 Drawing Sheets

(56) References Cited

U.S. PATENT DOCUMENTS

| | | | | |
|---|---|---|---|---|
| 2010/0197462 | A1* | 8/2010 | Piane, Jr. | A63B 21/00 482/8 |
| 2011/0287910 | A1* | 11/2011 | Ladd | A63B 21/153 482/133 |
| 2014/0194250 | A1* | 7/2014 | Reich | A63B 24/0084 482/5 |
| 2014/0357457 | A1* | 12/2014 | Boekema | A63B 21/154 482/124 |
| 2015/0011368 | A1 | 1/2015 | Manor et al. | |
| 2015/0024911 | A1 | 1/2015 | Ross | |
| 2016/0354629 | A1* | 12/2016 | Salamon | A63B 23/03508 |
| 2017/0304679 | A1* | 10/2017 | Orfield | A63B 21/0724 |
| 2020/0001129 | A1* | 1/2020 | Hsieh | A63B 21/015 |
| 2020/0254309 | A1* | 8/2020 | Watterson | A63B 21/0724 |
| 2021/0339078 | A1* | 11/2021 | Akeel | A63B 24/0087 |
| 2022/0184452 | A1* | 6/2022 | Valente | A63B 21/156 |
| 2023/0241447 | A1* | 8/2023 | Canole | A63B 21/025 482/121 |
| 2024/0123292 | A1* | 4/2024 | Gregory | A63B 23/1281 |
| 2024/0189651 | A1* | 6/2024 | Drayer | A63B 23/03516 |

OTHER PUBLICATIONS

Korean Patent Office, Written Opinion issued in PCT/US2023/0189731, Aug. 21, 2023, 13 pages.

* cited by examiner

RETRACTION DEVICE

BACKGROUND

Providing a full body exercise often requires various pieces of equipment. It can also be desired to alter a weight or resistance of the equipment. Accordingly, many people are challenged to get in a time efficient exercise regimen and often struggle to exercise while traveling or when a gym and other workout equipment is not accessible. Additionally, many forms of physical therapy can require the use of exercises for stretching and lifting with varying levels of resistance and energy transfer via movement. A need exists for a portable device that enables both focused and full body exercise at variable levels of resistance and energy transfer via movement.

SUMMARY

The present disclosure includes one or more of the features recited in the appended claims and/or the following features which, alone or in any combination, may comprise patentable subject matter.

According to a first aspect of the disclosed embodiments, a retraction apparatus includes an anchor device configured to attach to at least one of a user or a fixed location. A housing is coupled to the anchor device. A retractable cable extends from the housing and is configured to move between a retracted position and an extended position. An attachment mechanism is configured to couple to a free end of the retractable cable. A tensioning mechanism is configured to restrict movement of the retractable cable from the retracted position to the extended position.

In some embodiments of the first aspect, the retractable cable can be connected to a resistance device. The tensioning mechanism can restrict movement of the resistance device. The tensioning mechanism can include at least one of a spring, a magnet, an electronic resistance device, a motor, and an elastic cable. A sensor can be configured to detect properties of the retractable cable as the retractable cable moves between the retracted position and the extended position. The sensor can include at least one RFID tag attached to the retractable cable. An RFID reader can be positioned in the housing and configured to detect the at least one RFID tag. The sensor can measure at least one of a number of extensions, a time of use, a speed, a velocity, an acceleration, a length, a weight, work and energy transfer, a vector, or a direction of the retractable cable. A display can be configured to display the properties of the retractable cable. A wireless transceiver can be provided to transferred data related to movement of the retractable cable to a remote device.

According to a second aspect of the disclosed embodiments, a retraction apparatus includes an anchor device configured to attach to at least one of a user or a fixed location. A housing is coupled to the anchor device. A plurality of retractable cables extend from the housing and are configured to move between a retracted position and an extended position. Each of the plurality of retractable cables is tensioned to restrict movement of the plurality of retractable cable from the retracted position to the extended position. An attachment mechanism configured to couple to a free end of at least one of the retractable cables.

In some embodiments of the second aspect, the attachment mechanism can be configured to couple different combinations of the plurality of retractable cables to vary a tension of the apparatus. Each of the plurality of retractable cables can be identified with a different indicia. A plurality of resistance devices can be provided. Each of the plurality retractable cables can be connected to one of the plurality of resistance devices. A plurality of tensioning mechanisms can be provided. Each of the plurality of tensioning mechanisms can be configured to restrict movement of one of the plurality of retractable cables. A sensor can be configured to detect properties of the plurality of retractable cables as the plurality of retractable cables move between the retracted position and the extended position. Each of the plurality of retractable cables can be differently tensioned. A wireless transceiver can be provided to transferred data related to movement of the retractable cable to a remote device.

According to a third aspect of the disclosed embodiments, a retraction apparatus includes an anchor device configured to attach to at least one of a user or a fixed location. A housing is coupled to the anchor device. A retractable cable extends from the housing and is configured to move between a retracted position and an extended position. An attachment mechanism is configured to couple to a free end of the retractable cable. A sensor is configured to detect properties of the retractable cable as the retractable cable moves between the retracted position and the extended position.

In some embodiments, the sensor can include at least one RFID tag attached to the retractable cable. An RFID reader can be positioned in the housing and can be configured to detect the at least one RFID tag. The sensor can measure at least one of a number of extensions, a time of use, a speed, a velocity, an acceleration, a length, a weight, work and energy transfer, a vector, or a direction of the retractable cable. A display can be provided to display the properties of the retractable cable as measured by the sensor. A plurality of retractable cables can extend from the housing and can be configured to move between a retracted position and an extended position. Each of the plurality of retractable cables can be differently tensioned. A wireless transceiver can be provided to transferred data related to movement of the retractable cable to a remote device.

According to a fourth aspect of the disclosed embodiments, a retraction apparatus includes an anchor device configured to attach to at least one of a user or a fixed location. A housing is coupled to the anchor device. A retractable cable extends from the housing and is configured to move between a retracted position and an extended position. A plurality of interchangeable attachment mechanisms are configured to attach to a free end of the retractable cable.

In some embodiments of the fourth aspect, at least one of the plurality of interchangeable attachment mechanisms can be coupleable to a limb of the user. At least one of the plurality of interchangeable attachment mechanisms can be usable to perform an exercise.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying FIGURES in which.

DETAILED DESCRIPTION

Figure 1:
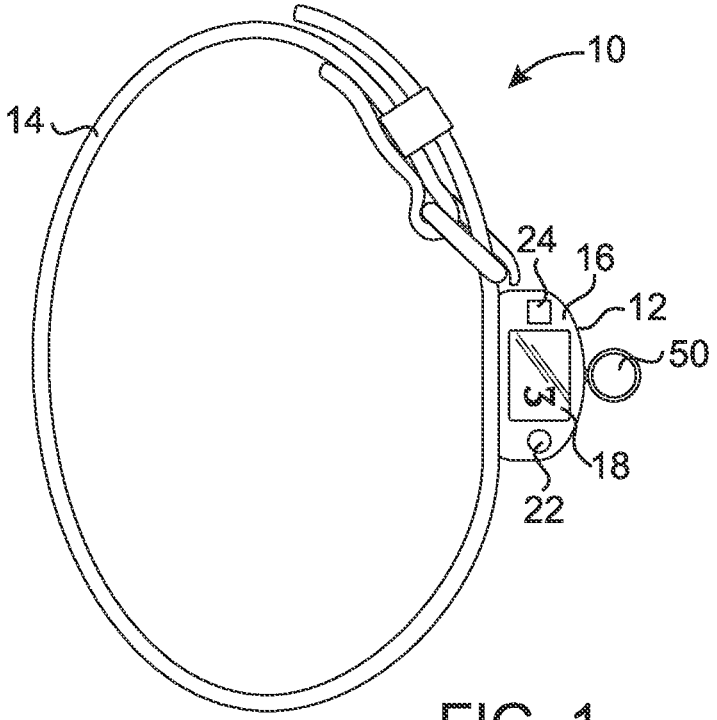
FIG. 1 is a top view of a retraction device having an anchor device and a retractable cable extending from the anchor device, wherein the retractable cable is in a retracted position.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Unless defined otherwise, technical and scientific terms used herein have the same meaning as commonly understood by one of ordinary skill in the art to which the claimed material belongs. The following terms are defined below.

"coupleable" in this context refers to being able to be mechanically joined via force(s) generated by adhesion, cohesion, friction, fastening, magnetism, tension, etc.

"fastener" in this context refers to a hardware device that mechanically joins or affixes two or more objects together, generally used to create non-permanent joints (e.g., releasable or lockable), including anchor bolts, battens, bolts (including screws), brass fasteners, buckles, buttons, cable ties, captive fasteners, clamps (or cramps, including hose clamps), clasps (including lobster clasps), clekos, clips (including circlips, hairpin clips, paper clips, and terry clips), clutches, drawing pins (thumbtack), flanges, frogs, grommets, hook-and-eye closures, hook and loop fasteners (including Velcro), latches, nails, pegs (including clothespins and tent pegs), PEM nuts, pins (including bowtie cotter pins, circle cotters, clevis fasteners, cotters, dowels, linchpins, R-clips, split pins, spring pins, and tapered pins), retaining rings (including circlips and e-rings), rivets, rock bolts, rubber bands (or bands of other materials), screw anchors, snap fasteners, staples, stitches, straps, threaded fasteners (including captive threaded fasteners, nuts, screws, washers, threaded inserts, and threaded rods), ties, toggle bolts, treasury tags, twist ties, wedge anchors, and zippers.

Referring now to FIG. 1, a retraction device 10 is configured for use as an exercise device or a device that assists in the movement of a load. The retraction device 10 includes an anchor device 12 that is coupleable to a user or a fixed location. For example, in some embodiments, the anchor device 12 is coupleable to a user's waist. In other embodiments, the anchor device 12 is coupleable to a door frame or other fixed location. The anchor device 12 includes strap 14 that is configured to wrap around and secure to the user or the fixed location. In other embodiments, the anchor device 12 includes any other suitable fastener.

The anchor device 12 includes a housing 16 attached to the strap 14 and configured to internally house various components of the retraction device 10. A display 18 is formed on the housing 16 and configured to display data related to the use of the retraction device 10. In some embodiments, the display 18 includes a touchscreen having buttons to toggle through various screens illustrated on the display 18. In other embodiments, buttons are incorporated into the housing 16. An input/output 24 enables the retraction device 10 to couple to various remote devices including, but not limited, to a computer, a handheld device, a watch, etc., to transfer data between the retraction device 10 and the remote device. In some embodiments, the retraction device 10 includes a wireless transceiver 20 (shown in FIG. 6) to transfer data received from a sensor (described below) to a remote device, for example, a remote computer or handheld device. In some embodiments, the remote device includes an application or software for compiling and analyzing the data received from the sensor. In some embodiments, the wireless transceiver 20 is a Bluetooth transceiver. An indicator 22 is also provided on the housing 16 to send alerts to a user during use of the retraction device 10. In one embodiment, the indicator 22 is a light that sends visual alerts to the user. In another embodiment, the indicator 22 is a speaker that sends audible alerts to the user. In yet another embodiments, the housing 16 includes both a speaker and a light.

Figure 2:
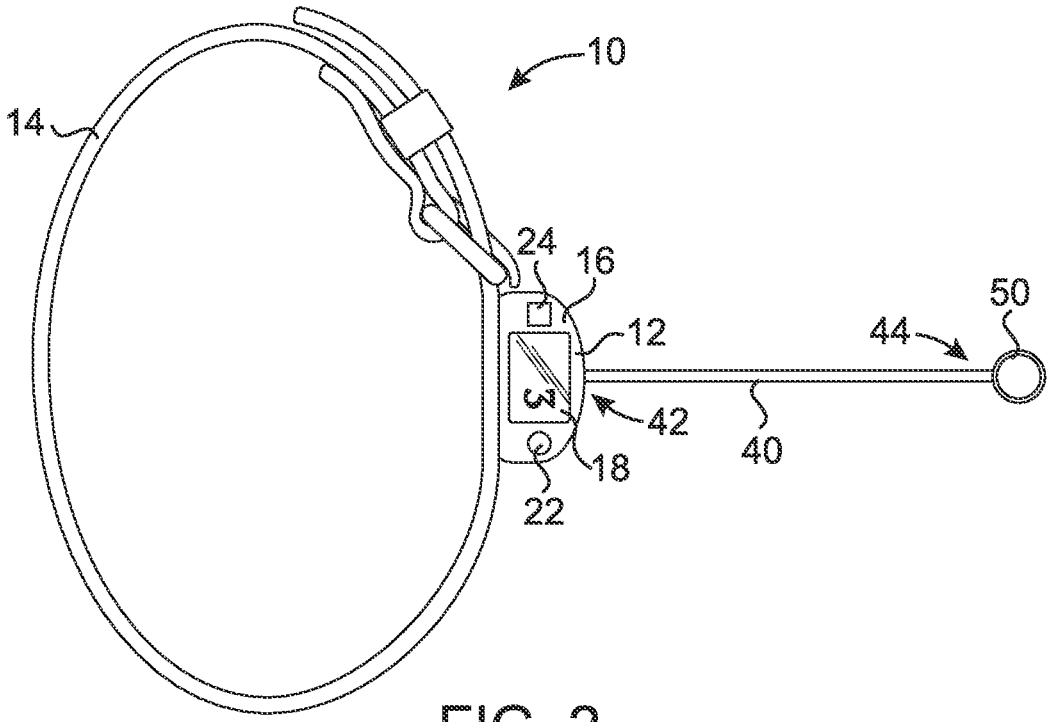
FIG. 2 is a top view of the retraction device, shown in FIG. 1, wherein the retractable cable is in an extended position.

An extendable and retractable cable 40 extends from the housing 16 from a housing end 42 to a free end 44. In the illustrated embodiment, the cable 40 extends approximately from a center of a front side of the housing 16. In some embodiments, the cable 40 extends from any location of any side of the housing 16. In some embodiments, the cable 40 is formed from any material and has any elasticity. The cable 40 is configured to move between a retracted position (shown in FIG. 1) and an extended position (shown in FIG. 2). When moving from the retracted position to the extended position, the free end 44 of the cable 40 moves away from the housing 16. When extending from the extended position to the retracted position, the free end 44 of the cable 40 moves toward the housing 16. The cable 40 is biased toward the retracted position. In some embodiments, the cable 40 is capable of being locked at any position, for example, the retracted position, the extended position, or at a position between the retracted position and the extended position.

Figure 3:
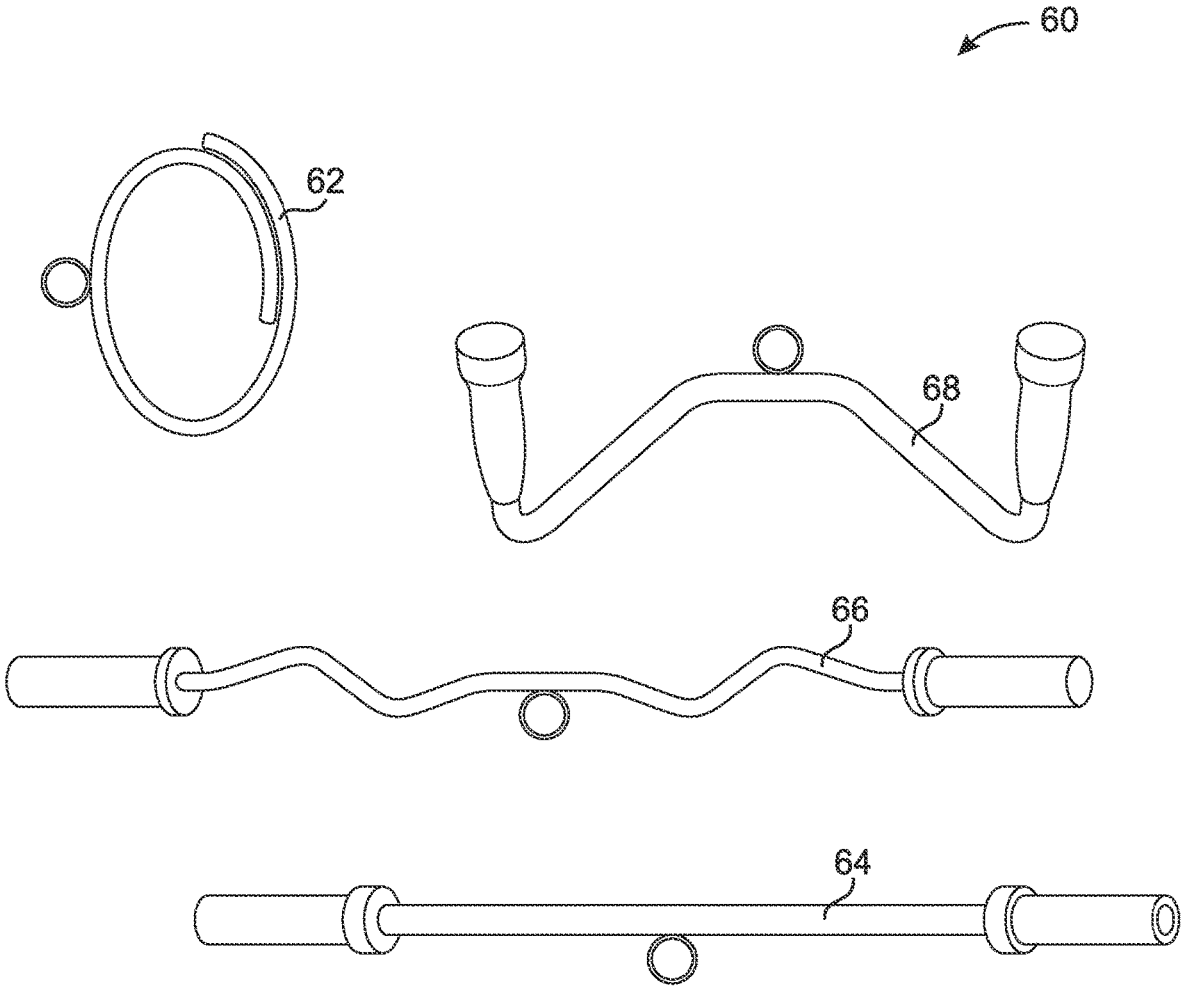
FIG. 3 is a top view of a plurality of exemplary attachment mechanisms that are configured to couple to a free end of the retractable cable, shown in FIGS. 1 and 2.

A fastener 50 is coupled to the free end 44 of the cable. In the illustrated embodiment, the fastener 40 is a clip. The fastener 50 is coupleable to an attachment mechanism 60 that is configured to be gripped by a user or is coupleable to a load. FIG. 3 illustrates a plurality of exemplary attachment mechanisms 60 including a strap 62, a long two-handed bench press bar 64, a short one-handed bar 66, and a short two-handed bar 68. It will be appreciated that any of the attachment mechanisms 60 shown in FIG. 3 are usable during exercise. Additionally, the strap 62 is useable to attach to and move a load. Any other exercise or load moving attachments are contemplated by this disclosure.

During use, the cable 40 is moved between the retracted position and the extended position for exercise or load moving. A tensioning mechanism (as described below) adds tension to the cable 40 to resist movement of the cable 40 between the retracted position and the extended position. In some embodiments, the tension provides resistance during exercise. In other embodiments, the tension adds resistance to ease the movement of a load. In some embodiments, the tensioning mechanism locks the cable 40 and prevents movement of the cable 40. In some embodiments, the tensioning mechanism is at least one of spring, a magnet, an electronic resistance device, a motor, and an elastic cable to create tension attributable to the retractable cable. The tensioning mechanism can provide consistent or variable resistance to the retractable cable.

The control circuitry 70 measures various properties of the cable movement. In some embodiments, the control circuitry 70 measures a number of extensions of the cable 40, a time of use, a distance traveled by the cable 40, a weight of a load coupled to the cable 40, a velocity of the cable 40, an acceleration of the cable 40, a vector of the cable 40, a direction of the cable 40, a force applied to the cable 40, an altitude of the cable 40, and/or a location of the cable 40. It will be appreciated that the preceding list in not an exhaustive list of properties that are capable of being measured by the control circuitry 70. The control circuitry 70 provides visual or auditory feedback to one of the indicator 22 and/or the display 18. In some embodiments, the wireless transceiver 20 and/or the input/output 24 transfers feedback and/or data to the remote device. In some embodiments, the properties of the retractable cable 40 can be transmitted by wired or wireless connection to a display utilizing any software or application necessary to provide such display.

Figure 4:
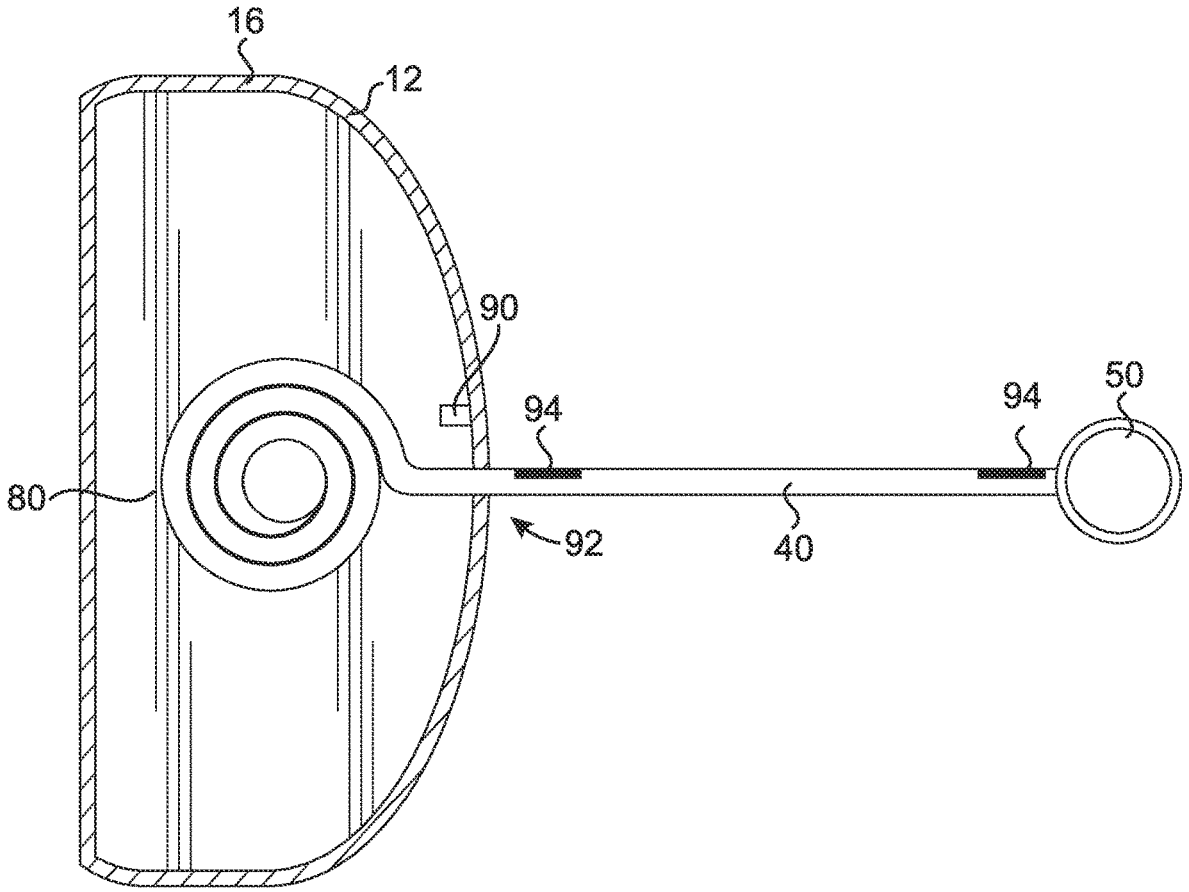
FIG. 4 is a top view of the retraction device, shown in FIGS. 1 and 2, including a cut-away view of the anchor device showing a resistance device that the retractable cable is connected to, wherein at least one RFID tag is attached to the retractable cable and an RFID reader is positioned in the housing.

Referring now to FIG. 4, a resistance device 80 is positioned within the housing 16. In the illustrated embodiment, the resistance device is a spool and the cable 40 is wound around the resistance device 80. In other embodiments, the resistance device 80 is a rod, and electric motor, or other suitable resistance device and the cable 40 is connected to the resistance device 80. The housing end 42 of the cable 40 remains attached to the resistance device 80 at all times during extension and retraction of the cable 40. A radio frequency identification (RFID) reader 90 is positioned within the housing 16. The RFID reader 90 is positioned adjacent an opening 92 in the housing 16 through which the cable 40 extends. A plurality of RFID tags 94 are positioned on the cable 40. In an exemplary embodiment, the RFID tags 94 are equally spaced along a length of the cable 40. As the cable 40 extends from and retracts into the housing 16, at least some of the RFID tags 94 pass the RFID reader 90 and are read by the RFID reader 90. The control circuitry 70 determines properties of the cable's movement based on data received from the RFID reader 90, wherein the data is indicative of when each RFID tag 94 passed the RFID reader 90. In some embodiments, the RFID reader 90 is used to measure velocity, acceleration, and/or distance.

Figure 5:
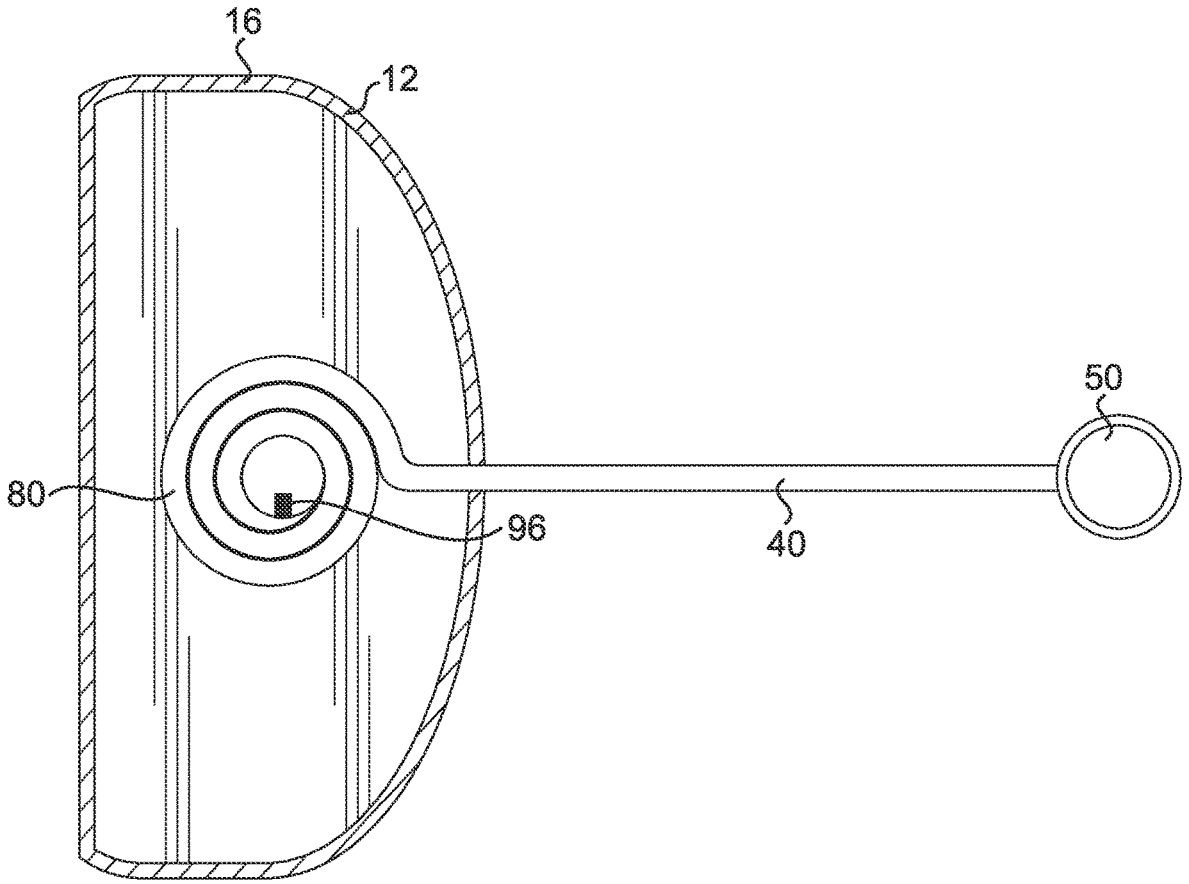
FIG. 5 is view similar to FIG. 4, wherein the anchor device includes a sensor.

In one embodiment, shown in FIG. 5, the resistance device 80 includes at least one sensor 96 to measure properties of the resistance device 80. For example, in one embodiment, the sensor 96 is an accelerometer. In other embodiments, the sensor 96 includes any sensor suitable for measuring properties of the device. In some embodiments, the properties include a number of revolutions, a velocity of revolutions, and/or an acceleration of the resistance device 80. The control circuitry 70 uses data from the sensor 96 to calculate properties of the cable 40. It will be appreciated that the RFID reader 90 of FIG. 4 and the sensor 96 are used together in some embodiments. In other embodiments, the RFID reader 90 and the sensor 96 are used independently. It will be appreciated that in one embodiment, at least one of the RFID reader 90 and/or the sensor 96 tracks a number of times that the cable 40 is extended and retracted. In some embodiments, the display 18 includes a counter that displays the number of extensions and retraction. In other embodiments, a mechanical counter tracks the number of extensions and retractions. It will be appreciated that, in some embodiments, the sensor includes a mechanical counter. In some embodiments, the sensor 96 and/or RFID reader 90 has the ability to measure a speed, a velocity, an acceleration, a length, a weight, a work and energy transfer, a vector, a direction, or other physical and locational attribute of the retractable cable 40.

Figure 6:
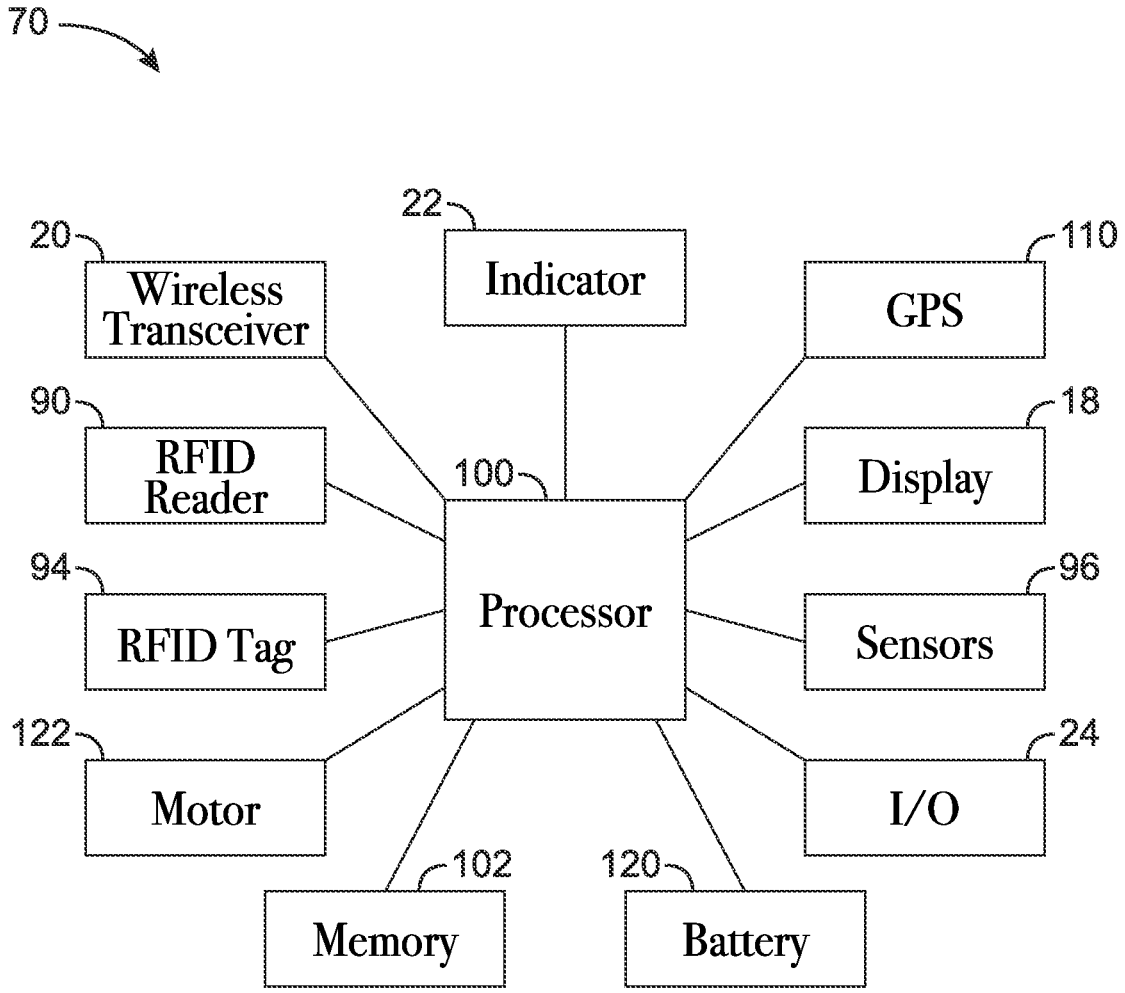
FIG. 6 is a schematic view of control circuitry for the retraction device, wherein the control circuitry is housed in the anchor device.

The control circuitry 70 is illustrated in FIG. 6 and includes at least one processor 100 and a memory 102. In some embodiments, the control circuitry 70 is housed in the housing 16. In other embodiments, at least a portion of the control circuitry 70 is housed in a remote device that is in communication with the device 10. The memory 102 stores instructions that cause the processor to perform as described herein. The display 18, the input/output 24, the wireless transceiver 20, and the indicator 22 are all coupled to the processor 100 so that the processor 100 provides feedback as described herein. The RFID reader 90 and the sensor 96 are also coupled to the processor 100. The memory 102 includes instructions that, when read by the processor 100, cause the processor 100 to calculate and determine the properties of the cable 40 described above based on signals from the RFID reader 90 and the sensors 96.

The control circuitry 70 includes a global positioning system (GPS) 110, in some embodiments. Based on data from the GPS 110, the processor 100 can determine a location and altitude of the retraction device 10. In some embodiments, the GPS 110 calculates a direction of movement of the free end 44 of the cable 40. Accordingly, the processor 100 uses the data from the GPS 110 to determine a vector of the cable 40 as the cable 40 is extended and retracted.

A battery 120 is provided to power the control circuitry 70. In the illustrated embodiment, the battery 120 also powers an electric motor 122. In some embodiments, the electric motor 122 provides forces on the cable 40 opposite the extension of cable 40. Accordingly, the motor 122 provides tension on the cable 40 to assist in exercise or moving a load.

Figure 7:
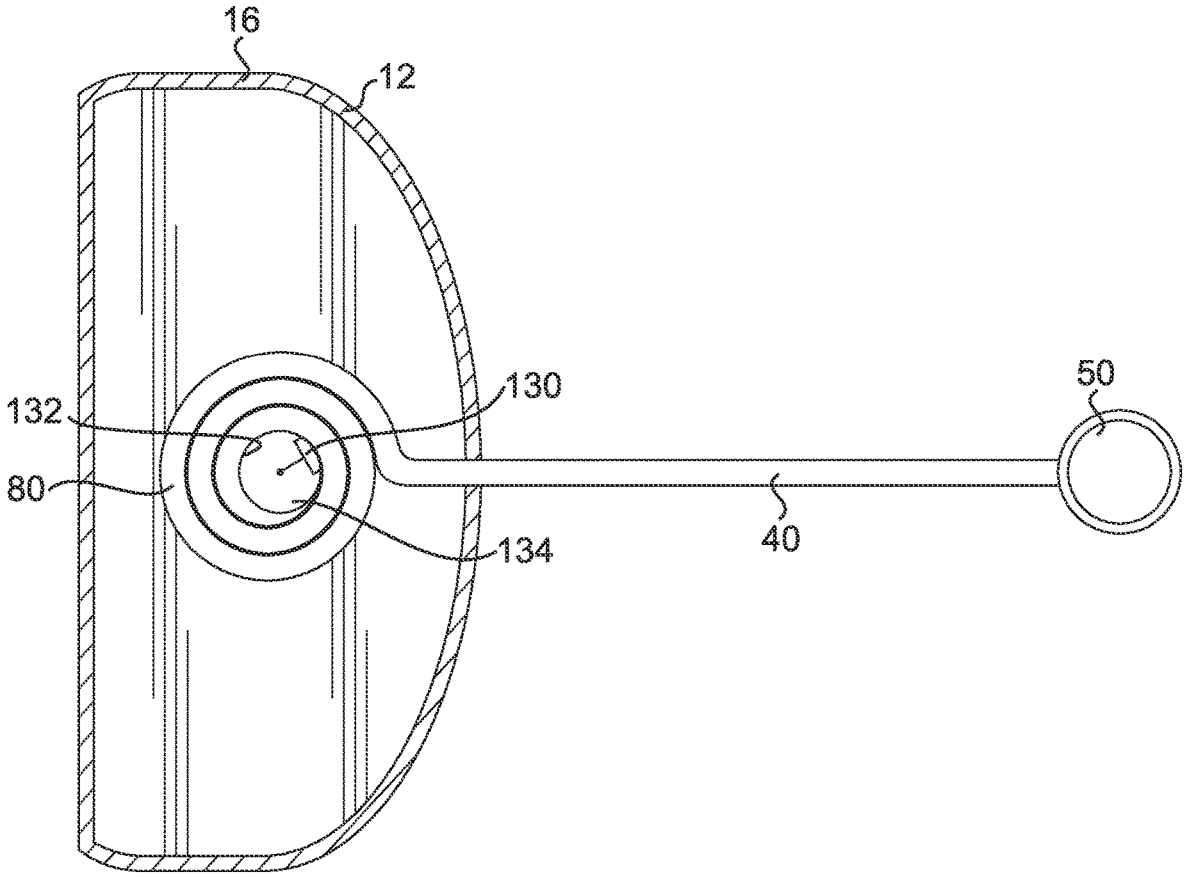
FIG. 7 is a view similar to FIG. 4, wherein a tensioning mechanism is provided to restrict movement of the resistance device.

Referring now to FIG. 7, a tensioning mechanism 130 restricts movement of the cable 40 between the retracted position and the extended position. In some embodiments, the tensioning mechanism 130 locks the cable 40 and prevents movement of the cable 40. In some embodiments, the tensioning mechanism 130 is disengaged and does not restrict movement of the cable 40. In some embodiments, the tensioning mechanism 130 includes a plate, for example, a plate with a felt pad. In the illustrated embodiment, the tensioning mechanism 130 is moveable into contact with the resistance device 80. The tensioning mechanism 103 is moveable into contact with an inner circumference 132 of the resistance device 80 or a sidewall 134 of the resistance device 80. The more contact made between the tensioning mechanism 130 and the resistance device 80, the more friction that is created to slow the resistance device 80. In some embodiments, the resistance device 80 is metal and the tensioning mechanism 130 is a magnet. In such an embodiment, the tensioning mechanism 130 does not directly contact the resistance device 80, but rather, the resistance device 80 is slowed by magnetic force.

Figure 10:
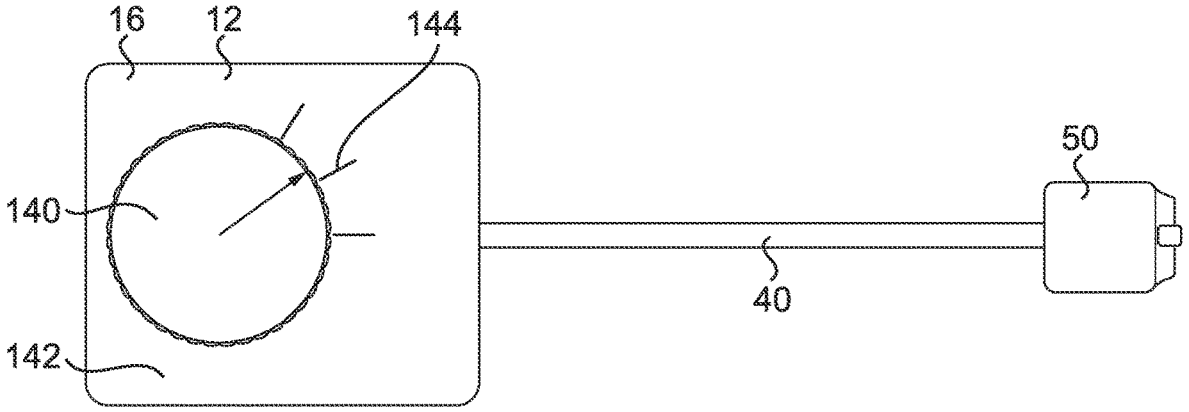
FIG. 10 is a top view of the anchor device, shown in FIGS. 1 and 2, wherein a dial is provided to adjust a tension of the retractable cable.

In an illustrated embodiment, the tensioning mechanism 130 can be adjusted, for example, by adjusting a dial 140 (shown in FIG. 10) positioned on an outer surface 142 of the housing. The dial 140 is rotatable to different settings 144, each of which represent a different level of tension, for example, 1 pound of tension, 3 pounds of tension, and 5 pounds of tension. In another embodiment, adjustment of the tensioning mechanism 130 is controlled electronically, for example, by entering a tension setting into the display 18. In such an embodiment, the control circuitry 70 electronically adjusts the position of the tensioning mechanism 130.

Figure 8:
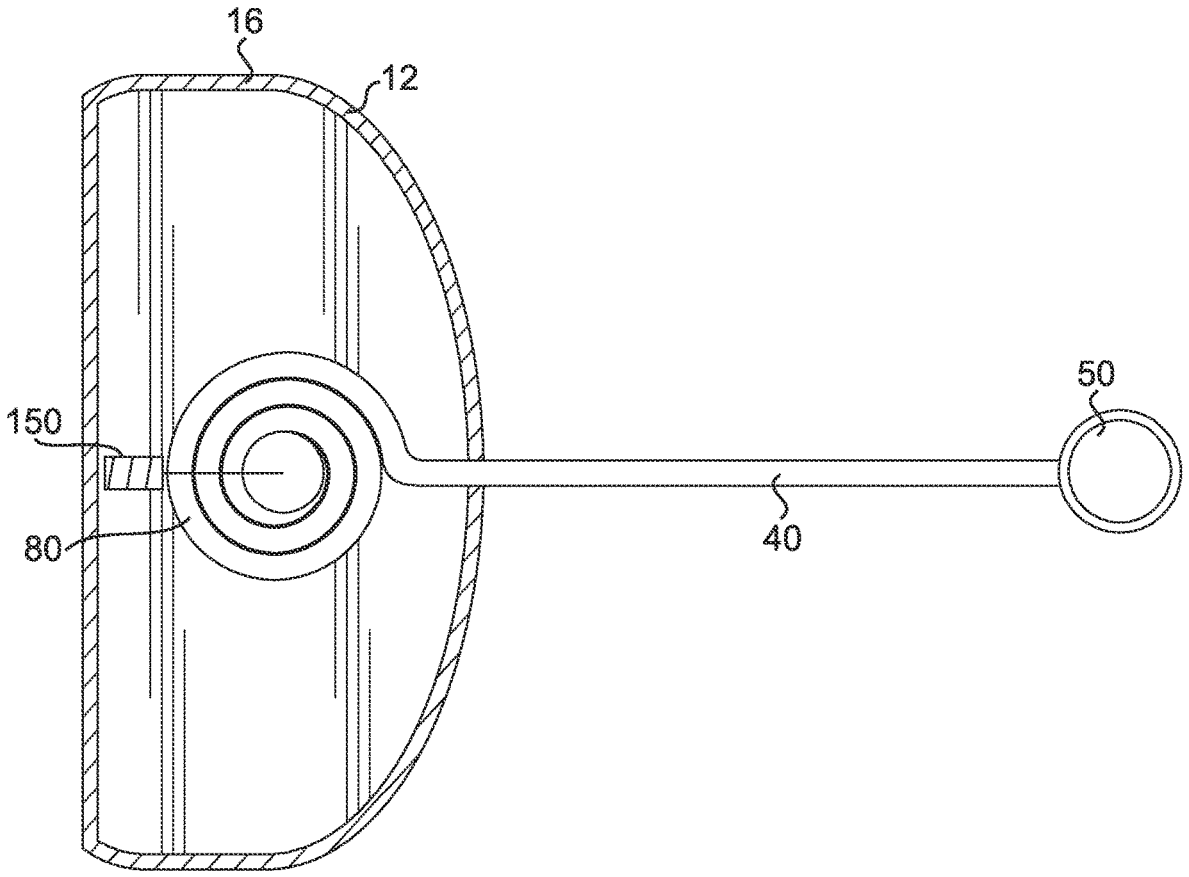
FIG. 8 is a view similar to FIG. 4, wherein a spring is provided to restrict movement of the resistance device.

Referring to FIG. 8, in some embodiments, a spring 150 biases the resistance device 80 to provide tension to the cable 40. The spring 150 is usable with the tensioning mechanism 130, in some embodiments. In one embodiment, the amount of tension provided the spring 150 is adjustable by stretching the spring 150. For example, the dial 140 is used in one embodiment to stretch the spring 150. In some embodiments, the spring 150 is adjusted electronically by the control circuitry 70.

Figure 9:
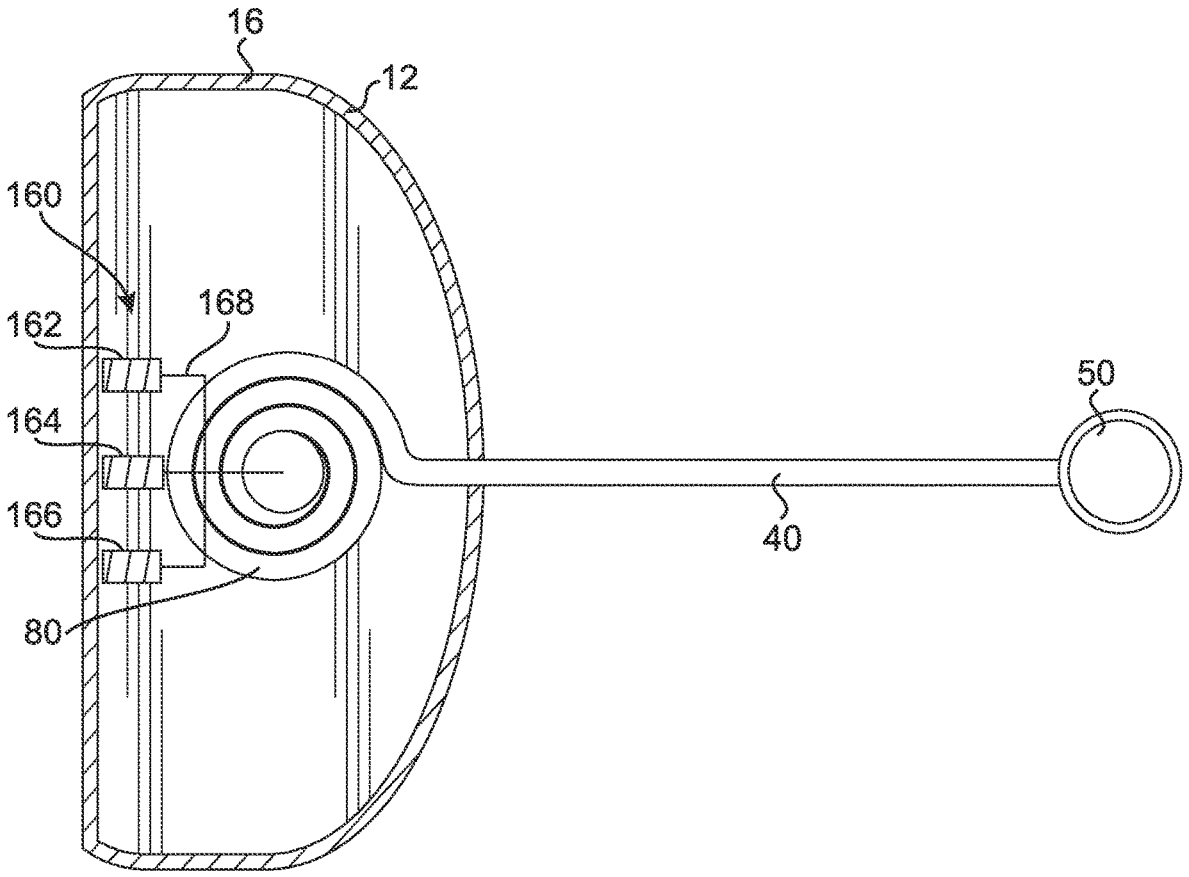
FIG. 9 is a view similar to FIG. 4 and including a gear system to attach to one of plurality of springs that restrict movement of the resistance device.

In the embodiment shown in FIG. 9, the retraction device 10 includes a plurality of springs 160. In one embodiment, each spring 160 provides a different measure of tension. For example, spring 162 provides one pound of tension, spring 164 provides three pounds of tension, and spring 166 provides five pounds of tension. The spring 160 is selectable by the dial 140, in some embodiments, or electronically, in some embodiments, by using a gear system 168 to couple the cable 40 to one of the springs 162, 164, or 166. In some embodiments, multiple springs 160 are coupleable to the cable 40 to provide a different tension. For example, if the cable 40 is coupled to spring 162 and spring 166, six pounds of tension is provided to the cable 40. Coupling the cable 40 to all three springs 160, would provide eleven pounds of tension to the cable 40.

Figure 11:
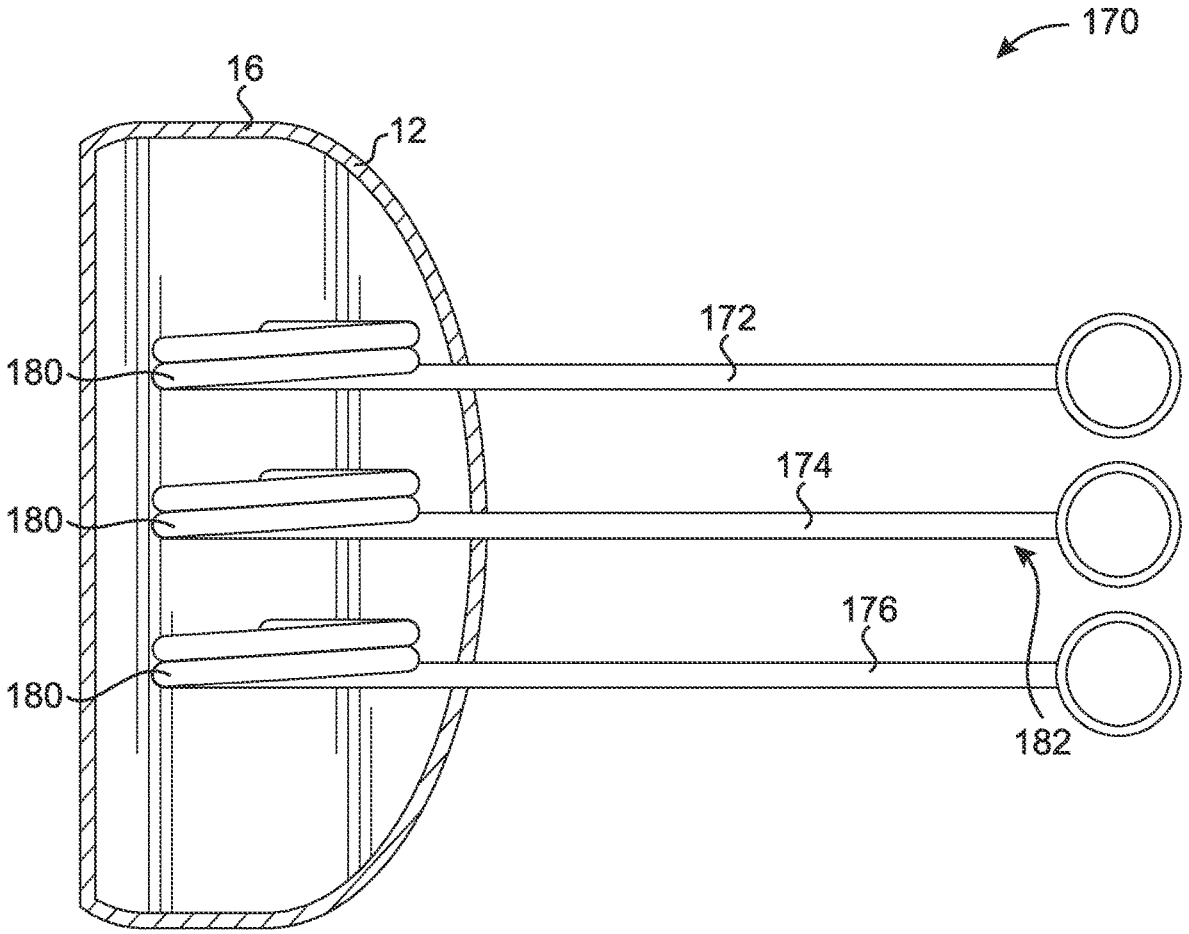
FIG. 11 is a view similar to FIG. 4 and showing a plurality of retractable cables.

In the embodiment shown in FIG. 11, the retraction device 10 includes a plurality of extendable and retractable cables 170. Each cable 170 is would around a separate resistance device 180. Accordingly, each cable 170 is extendable and retractable at a different speed, acceleration, and direction. In some embodiments, a free end 182 of each cable 170 is coupleable to a different body part of a user so that the user can exercise and practice using full body motion. For example, to practice a baseball swing, one cable 170 is coupleable to each arm and one cable 170 is coupleable to a leg of the user. Although the illustrated embodiment only shows three cables 170, the retraction device 10 can include any number of cables 170. In an embodiment with fours cables 170, two cables 170 are coupleable to each arm and two cables 170 are coupleable to each leg.

In one embodiment, each cable 170 provides a different measure of tension. For example, cable 172 provides one pound of tension, cable 174 provides three pounds of tension, and cable 176 provides five pounds of tension. The cables 170 are tensioned, in one embodiment, using any of the tensioning mechanisms or springs describe herein. The cables 170 are selected by attaching at least one cable 17 to an attachment mechanism 60 or a load. In some embodiments, multiple cables 170 are useable to provide different tensions. For example, if cable 172 and cable 176 are used, six pounds of tension is provided. Coupling an attachment mechanism 60 or load to all three cable 170, would provide eleven pounds of tension. In some embodiments, the tension of each cable 170 is adjustable as described herein to increase the number of tension combinations. Additionally, in some embodiments, each cable 170 includes indicia or coloring to identify the cable 170.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless cannot be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used, the item can include a portion and/or the entire item unless specifically stated to the contrary. It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles have been presented, they need not be utilized in combination, and many combinations of aspects and principles are possible in light of the various embodiments provided above.

What is claimed is:

1. A retraction apparatus comprising:

an anchor device;

a housing coupled to the anchor device;

a retractable cable extending from the housing and configured to move between a retracted position and an extended position, wherein the retractable cable is wound around a resistance device;

an attachment mechanism configured to couple to a free end of the retractable cable; and a plurality of tensioning mechanisms configured to restrict movement of the retractable cable from the retracted position to the extended position by utilizing a gear system to couple one of tensioning mechanisms to the resistance device to restrict movement of the resistance device, wherein the anchor device is configured to attach to a user and the attachment mechanism configured to couple to the free end of the retractable cable is configured to attach to the user.

2. The retraction apparatus of claim 1, wherein the tensioning mechanism includes at least one of a spring, a magnet, an electronic resistance device, a motor, and an elastic cable.

3. The retraction apparatus of claim 1, further comprising a sensor configured to detect properties of the retractable cable as the retractable cable moves between the retracted position and the extended position.

4. The retraction apparatus of claim 3, wherein the sensor includes:

at least one RFID tag attached to the retractable cable; and an RFID reader positioned in the housing and configured to detect the at least one RFID tag.

5. The retraction apparatus of claim 3, wherein the sensor measures at least one of a number of extensions, a time of use, a speed, a velocity, an acceleration, a length, a weight, work and energy transfer, a vector, or a direction of the retractable cable.

6. The retraction apparatus of claim 3, further comprising a display to display the properties of the retractable cable.

7. The retraction apparatus of claim 1, further comprising a wireless transceiver to transferred data related to movement of the retractable cable to a remote device.

8. A retraction apparatus comprising:

an anchor device;

a housing coupled to the anchor device;

a plurality of retractable cables extending from the housing and configured to move between a retracted position and an extended position, wherein each retractable cable is wound around a respective resistance device, wherein each of the plurality of retractable cables is tensioned to restrict movement of a respective cable from the retracted position to the extended position by utilizing a gear system to couple one of a plurality of tensioning mechanisms to the resistance device to restrict movement of the resistance device; and an attachment mechanism configured to couple to a free end of at least one of the retractable cables, wherein the anchor device is configured to attach to a user and the attachment mechanism configured to couple to the free end of the retractable cable is configured to attach to the user.

9. The retraction apparatus of claim 8, wherein the attachment mechanism is configured to couple different combinations of the plurality of retractable cables to vary a tension of the apparatus.

10. The retraction apparatus of claim 8, wherein each of the plurality of retractable cables is identified with a different indicia.

11. The retraction apparatus of claim 8, further comprising a plurality of resistance devices, wherein each of the plurality retractable cables is connected to one of the plurality of resistance devices.

12. The retraction apparatus of claim 8, further comprising a plurality of tensioning mechanisms, wherein each of the plurality of tensioning mechanisms is configured to restrict movement of one of the plurality of retractable cables.

13. The retraction apparatus of claim 8, further comprising a sensor configured to detect properties of the plurality of retractable cables as the plurality of retractable cables move between the retracted position and the extended position.

14. The retraction apparatus of claim 8, further comprising a wireless transceiver to transferred data related to movement of the retractable cable to a remote device.

15. A retraction apparatus comprising:

an anchor device;

a housing coupled to the anchor device;

a retractable cable extending from the housing and configured to move between a retracted position and an extended position, wherein the retractable cable is wound around a resistance device, and wherein the retractable cable is tensioned to restrict movement of the retractable cable from the retracted position to the extended position by utilizing a gear system to couple one of a plurality of tensioning mechanisms to the resistance device to restrict movement of the resistance device;

an attachment mechanism configured to couple to a free end of the retractable cable; and a sensor configured to detect properties of the retractable cable as the retractable cable moves between the retracted position and the extended position, wherein the anchor device is configured to attach to a user and the attachment mechanism configured to couple to the free end of the retractable cable is configured to attach to the user.

16. The retraction apparatus of claim 15, wherein the sensor includes:

at least one RFID tag attached to the retractable cable; and an RFID reader positioned in the housing and configured to detect the at least one RFID tag.

17. The retraction apparatus of claim 15, wherein the sensor measures at least one of a number of extensions, a time of use, a speed, a velocity, an acceleration, a length, a weight, work and energy transfer, a vector, or a direction of the retractable cable.

18. The retraction apparatus of claim 15, further comprising a display to display the properties of the retractable cable as measured by the sensor.

19. The retraction apparatus of claim 15, further comprising a plurality of retractable cables extending from the housing and configured to move between a retracted position and an extended position.

20. The retraction apparatus of claim 19, wherein each of the plurality of retractable cables is differently tensioned.

21. The retraction apparatus of claim 15, further comprising a wireless transceiver to transferred data related to movement of the retractable cable to a remote device.

22. A retraction apparatus comprising:

an anchor device;

a housing coupled to the anchor device;

a retractable cable extending from the housing and configured to move between a retracted position and an extended position, wherein the retractable cable is wound around a resistance device, and wherein the retractable cable is tensioned to restrict movement of the retractable cable from the retracted position to the extended position by utilizing a gear system to couple one of a plurality of tensioning mechanisms to the resistance device to restrict movement of the resistance device; and a plurality of interchangeable attachment mechanisms configured to attach to a free end of the retractable cable, wherein the anchor device is configured to attach to a user and each of the plurality of interchangeable attachment mechanisms configured to couple to the free end of the retractable cable is configured to attach to the user.

23. The retraction apparatus of claim 22, wherein at least one of the plurality of interchangeable attachment mechanisms is coupleable to a limb of the user.

24. The retraction apparatus of claim 22, wherein at least one of the plurality of interchangeable attachment mechanisms is usable to perform an exercise.

* * * * *